United States Patent [19]

Leinfelt

[11] 4,195,383

[45] Apr. 1, 1980

[54] VACUUM CLEANER DEVICE

[75] Inventor: Karl E. Leinfelt, Stockholm, Sweden

[73] Assignee: Aktiebolaget Electrolux, Stockholm, Sweden

[21] Appl. No.: 890,509

[22] Filed: Mar. 27, 1978

[30] Foreign Application Priority Data

Mar. 30, 1977 [SE] Sweden ..... 7703645
Nov. 22, 1977 [SE] Sweden ..... 7713157

[51] Int. Cl.[2] ..... A47L 9/00
[52] U.S. Cl. ..... 15/339; 55/274; 116/268
[58] Field of Search ..... 15/339; 55/274, DIG. 34; 116/114 AD

[56] References Cited

U.S. PATENT DOCUMENTS

| | | | |
|---|---|---|---|
| 2,077,572 | 4/1937 | Lofgren | 116/114 AD X |
| 2,192,224 | 3/1940 | Forsberg | 55/274 |
| 3,934,543 | 1/1976 | Howard | 116/114 AD |

*Primary Examiner*—Christopher K. Moore
*Attorney, Agent, or Firm*—Alfred E. Miller

[57] ABSTRACT

The combination of a vacuum cleaner and dust container wherein the latter is provided with an air pervious portion connected to an attachment plate in the form of cardboard and the like. The attachment plate is provided with an inlet for dust-laden air. The attachment plate has a pressure-sensitive element, the movement of which indicates the degree of clogging of the dust container without the use of seals or filters.

15 Claims, 5 Drawing Figures

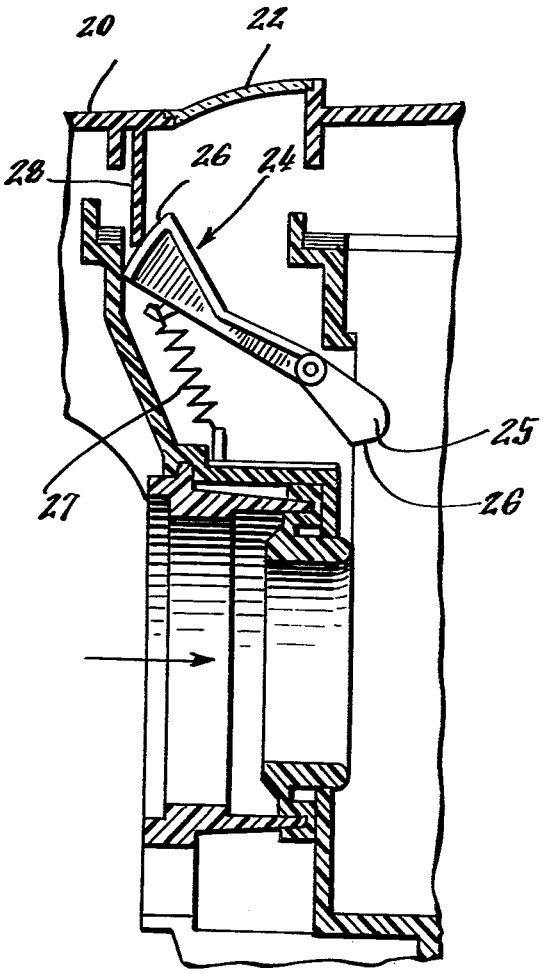
Fig. 3.
Fig. 4.
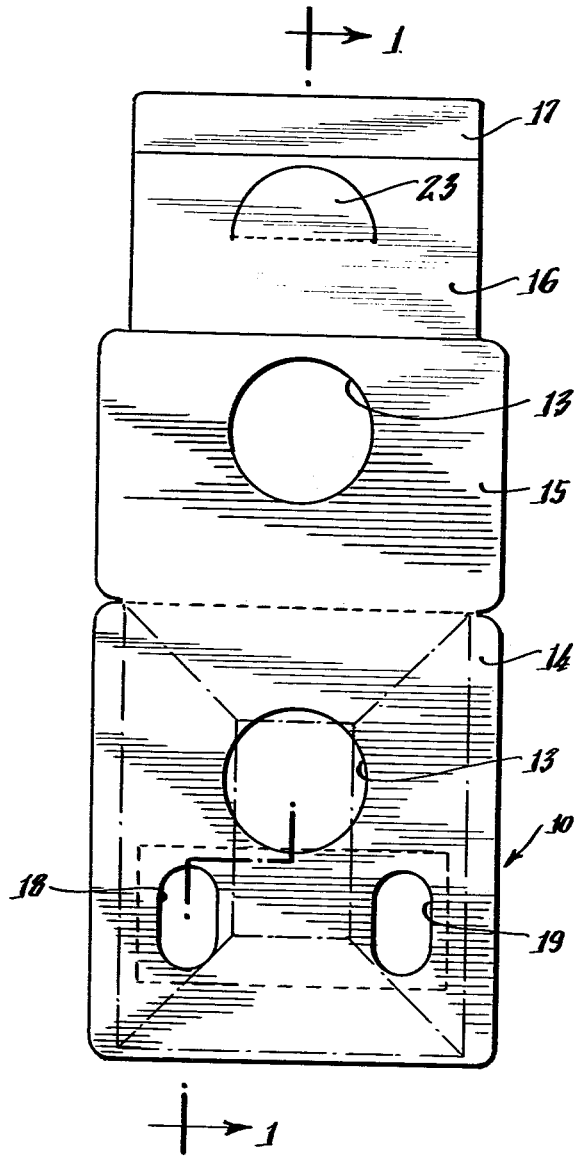
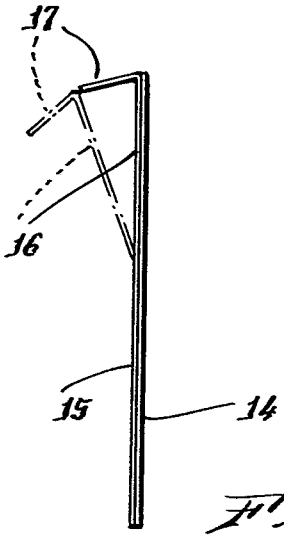
Fig. 5.

VACUUM CLEANER DEVICE

BACKGROUND OF THE INVENTION

The pressure difference between the outside and the inside of the dust container in known vacuum cleaner indicating devices acts upon means which can be displaced or rotated inside a cylindrical body. These means, through their movement, indicate the degree of clogging of the dust container. However, the above-described known indicators have a drawback in common in That they call for seals, for instance in the shape of rings or the like and often also special air filters for ensuring the safe operation of the device. It should be apparent that these sealing or filter devices increase the cost of the indicating devices, and moreover they call for periodical inspection so that the indicating device can function without fault.

A principal feature of the present invention is to eliminate these drawbacks and for this purpose the invention is essentially characterized in that the indicating means comprising a pressure-sensitive element arranged in the attachment plate, the movement of said element readily indicating the degree of clogging of the dust container.

In order that the invention will be more clearly understood, it will now be disclosed in greater detail with reference to the accompanying drawings, in which:

FIGS. 2 and 3 are sectional views of another embodiment of the present invention in which the indicator is in two different positions;

FIG. 4 is a plan view of the attachment plate of the dust container before its components have been folded together in the form shown in FIG. 5; and FIG. 5 is the assembled attachment plate with the swingable portion shown in dotted lines.

DESCRIPTION OF THE PREFERRED EMBODIMENTS

Figure 1:
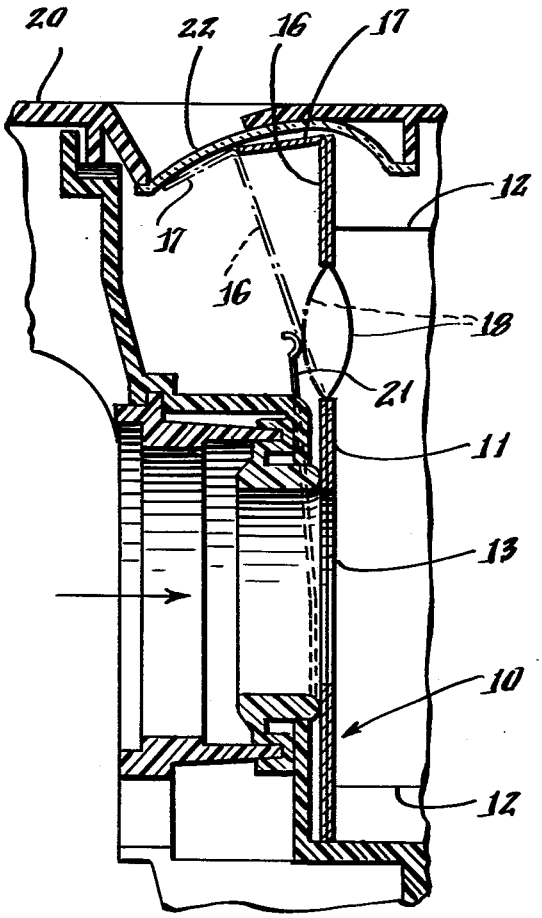
FIG. 1 is a sectional view of a part of a vacuum cleaner and dust container having a device for indicating the degree of clogging of a dust container constructed in accordance with the invention.

The dust container which, as a whole, is designated by the reference numeral 10 comprises an attachment plate 11 made of cardboard or similar material and an air pervious filtering portion 12. The attachment plate 11 has a substantially circular inlet opening 13 for dust-laden air and consists of two layers 14, 15 which are glued together, or in another suitable manner joined together as a unit, as shown in FIG. 5. Furthermore, a portion 16 of the layer 15 can be swung out of the plane of the attachment plate 11 and is provided at its end with a foldable portion 17.

An element sensitive to pressure in the shape of at least one resilient wall portion is arranged in the attachment plate 11 outside the inlet opening 13. As seen in FIG. 4 this element comprises two diaphragms 18, 19 which are mounted in the attachment plate in such a way that due to the pressure difference between the upstream and downstream sides of the dust container they can bulge to a certain degree out of the plane of the attachment plate 11. The magnitude of the bulging movement is around 5 mm., measured in a plane perpendicular to the plane of the attachment plate.

The operational mode of the indicating device is as follows:

After closing of the cover 20 of the vacuum cleaner the portion 17 is folded downwards as shown in FIG. 1.

When the vacuum cleaner is operated dust-laden air flows in the direction of the arrow through the inlet opening 13 and with increased degree of clogging of the dust container, the pressure outside or downstream in the container decreases, and due to this condition the slack diaphragm begins to move to the left in FIG. 1. Through this movement the diaphragm actuates the swingable portion 17 of the attachment plate so that the angle between the portion 16 and the plane of the attachment plate is continuously increasing (FIG. 1). A spring 21 thereby presses the portion 16 into contact with the diaphragm. Gradually the folded portion 17 of the attachment plate arranged under a window 22 indicates increasing degree of clogging of the dust container until the portion 16 reaches the position marked in FIG. 1 by dashed lines, which signifies that the filled dust container must be replaced. For a more distinct reading, the surface of the portion 16 adjacent to the window 22 can be provided with markings which indicate the degree of clogging.

The attachment plate shown in an unassembled state in FIG. 4 is further provided with a lug 23 cut out in the shape of a half circle in the portion 16, which lug, upon removal of the dust container and upon folding of the portion 16 into the plane of the attachment plate 11, is pressed a little inwards into the inlet opening 13 for securing of the portion 16 in this position, in which position the lug covers the opening 13, thus precluding dust from falling out through the opening.

Figure 2:
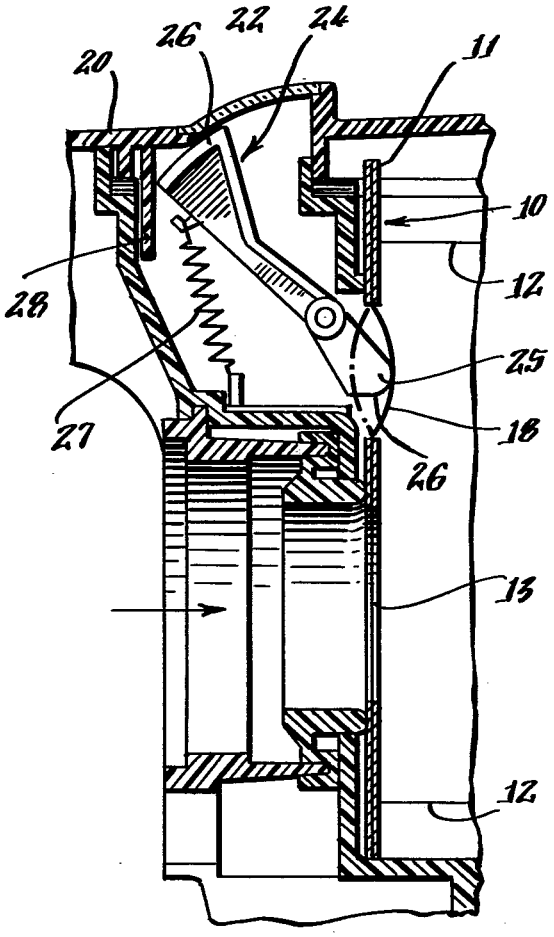

FIG. 2 discloses another embodiment of the indicating device constructed according to the present invention. In this embodiment the swingable portion 16 of the attachment plate 11 as seen in FIG. 1 has been replaced by a lever 24, pivoted in the apparatus, the inner end 25 of said lever lying against the outside of the diaphragm 18 and its outer end 26, because of its position under the window 22, visually indicating the condition of the dust container. Moreover, a tension spring 27 holds the inner end 25 of the lever in contact with the diaphragm 18.

In FIG. 2 the lever is shown in its initial position. Air flows into the apparatus in the direction of the arrow and with increased degree of clogging of the dust container, the curve of the diaphragm is gradually changed from the position marked by a solid line to the end position indicated by a dashed line. The movement of the diaphragm is transformed into a turning movement of the lever 24 so that its outer end 26 of the lever becomes more and more visible under the window 22, indicating when it is time to change the dust container.

Another inventive feature of the lever 24 is disclosed in FIGS. 2 and 3. The cover 20 has on its inner side an elevation 28, located essentially in a vertical inward direction into the apparatus. In case one should forget to place a dust container inside the apparatus, the following occurs, as seen in FIGS. 2 and 3: The inner end 25 of the lever 24 is moved by the tension spring 27 past the position in which the lever stands when there is a dust container in the apparatus, to another position shown in FIG. 3. Now if one tries to shut the cover 20 the outer end 26 of the lever 24 is struck by the elevation 28, which makes it impossible to move the cover further to its closing and locking position. Only after introducing a dust container does the lever take the position shown in FIG. 2, and the cover 20 of the vacuum cleaner can be closed.

The above embodiments are not intended to limit the invention to any extent, and therefore, several modifications are conceivable within the scope of the present invention.

What is claimed is:

1. In the combination of a vacuum cleaner provided with a housing and a dust container therein, said dust container having an air pervious portion connected to an attachment plate of cardboard or the like, said plate having an inlet opening for dust-laden air, the improvement comprising: a pressure sensitive element mounted in said attachment plate and movable in a predetermined direction upon the attainment of a specific pressure difference between the upstream and downstream side of said dust container, an indicating device coacting and moving with said pressure sensitive element and also affected by the specific pressure difference prevailing between the upstream and downstream sides of said dust container, and means in said vacuum cleaner housing for allowing observation from the exterior thereof of the position of said indicating device thereby determinating the degree of clogging of the dust container.

2. The combination as claimed in claim 1 wherein said pressure sensitive element comprises at least one resilient wall portion arranged on said attachment plate but outside of said inlet opening.

3. The combination as claimed in claim 2 wherein said resilient wall portion includes at least one diaphragm which moves out of the plane of said attachment plate to form a bulge due to the pressure difference prevailing between the upstream and downstream side of said dust container.

4. The combination as claimed in claim 3 wherein said bulge extends to about 5 mm. as measured in a plane perpendicular to the plane of said attachment plate.

5. The combination as claimed in claim 4 wherein one side of said diaphragm communicates with the downstream side of said dust container and the other side of said diaphragm communicates with the space at the outside upstream side of said diaphragm.

6. The combination as claimed in claim 3 wherein two spaced diaphragms are arranged in the attachment plate in a symmetrical relation to the center line thereof.

7. The combination as claimed in claim 2 wherein said indicating device is a cardboard portion having a peripheral part that is swingably secured to said attachment plate, and a spring means normally biasing said cardboard portion to a position in the plane of said attachment plate, said cardboard portion, upon a predetermined change in relative pressure between upstream and downstream locations of said dust container, moving away from the plane of said attachment plate and against the force of said spring means.

8. The combination as claimed in claim 7 wherein the housing has a window portion and the free end of said cardboard portion has a folded part visible through said window for a visual indication of the condition of the dust container during operation of said vacuum cleaner.

9. The combination as claimed in claim 8 wherein said folded part is an inverted L-shape with the bottom of said L being visible through said window.

10. The combination as claimed in claim 1 wherein said swingable cardboard portion, upon removal of said dust container from the vacuum cleaner housing, is foldable down to the plane of said attachment plate so that said inlet opening is substantially closed.

11. The combination as claimed in claim 2 wherein said housing is provided with a window portion and said indicating device is a pivoting lever which pivots about a point intermediate its ends and whereby one end thereof engages said pressure sensitive element so that upon movement of said element upon a predetermined change in relative pressure between upstream and downstream locations of said dust container the position of the other end of said pivoting lever visually indicates the condition of the dust container in said operative vacuum cleaner through said window portion.

12. The combination as claimed in claim 11 further comprising a tension spring arranged in said vacuum cleaner housing so as to press said inner end of said lever into contact with said diaphragm.

13. The combination as claimed in claim 12 further comprising abutment means on said vacuum cleaner housing, the latter having an openable cover with a downwardly extending projection, the other end of said lever being adapted to engage said abutment means and the projection on said cover engaging said other end of said lever to thereby prevent the closing of said vacuum cleaner housing cover when there is no dust container in the vacuum cleaner housing.

14. The combination as claimed in claim 12 wherein said abutment means is a projection on the inside of the cover, said projection when contacting said lever, prevents the vacuum cover free being closed when there is no dust container in the vacuum cleaner.

15. The combination as claimed in claim 12 wherein said tension spring is so constructed and arranged to move the lever beyond the furthest position it assumes during operation of the vacuum cleaner with a dust container, to a new position when there is no dust container in said vacuum cleaner.

* * * * *

UNITED STATES PATENT OFFICE

CERTIFICATE OF CORRECTION

PATENT NO. : 4,195,383

DATED : April 1, 1980

INVENTOR(S) : KARL ERIC LEINFELT

It is certified that error appears in the above-identified patent and that said Letters Patent are hereby corrected as shown below:

Column 4, line 43, change "free" to --from--.

Signed and Sealed this

Second Day of September 1980

[SEAL]

Attest:

SIDNEY A. DIAMOND

Attesting Officer

Commissioner of Patents and Trademarks